United States Patent [19]

Zufle

[11] Patent Number: 4,578,821

[45] Date of Patent: Apr. 1, 1986

[54] BODY ARMOR FOR WOMEN

[76] Inventor: Tim T. Zufle, 203 Lafayette St., Gretna, La. 70053

[21] Appl. No.: 625,354

[22] Filed: Jun. 27, 1984

[51] Int. Cl.[4] ..... F41H 1/02

[52] U.S. Cl. ..... 2/2.5; 2/92; 2/106; 2/133

[58] Field of Search ..... 2/2.5, 2, 92, 94, 105, 2/106, 114, 267, 76, 115

[56] References Cited

U.S. PATENT DOCUMENTS

| | | | |
|---|---|---|---|
| 4,183,097 | 1/1980 | Mellian | 2/2.5 |
| 4,266,297 | 5/1981 | Atkins | 2/2.5 |
| 4,316,286 | 2/1982 | Klein | 2/2.5 |

*Primary Examiner*—Werner H. Schroeder

*Assistant Examiner*—J. L. K. Olds

*Attorney, Agent, or Firm*—Harvey B. Jacobson

[57] ABSTRACT

An article of woman's body armor comprises a carrier garment such as a T-shirt or undervest with front and rear pockets for receiving armor insert panels of soft flexible bullet-resistant material. The front insert panel has slits extending from the side edges thereof with a pair of VELCRO hook and pile tabs on opposite sides of each slit, the tabs of each pair being secured respectively to opposite surfaces of the panel. The edge portions of the panel defining the respective slits can be overlapped and releasably secured by means of the VELCRO hook and pile tabs to form the panel into a bosom-accommodating cup-like shape with the degree of overlap determining the cup size.

9 Claims, 5 Drawing Figures

FIG. 1
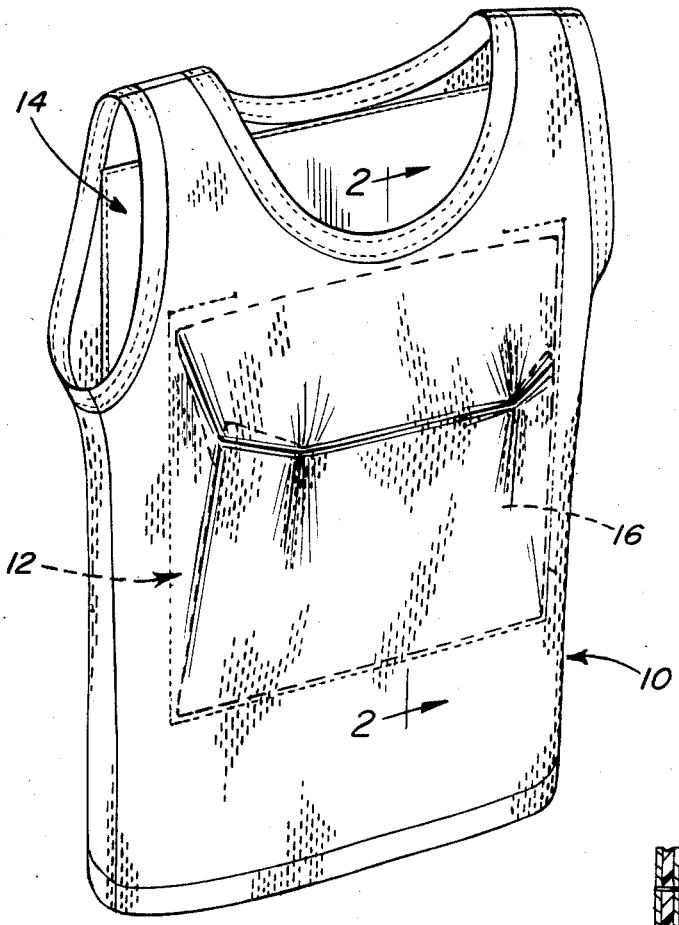
FIG. 2
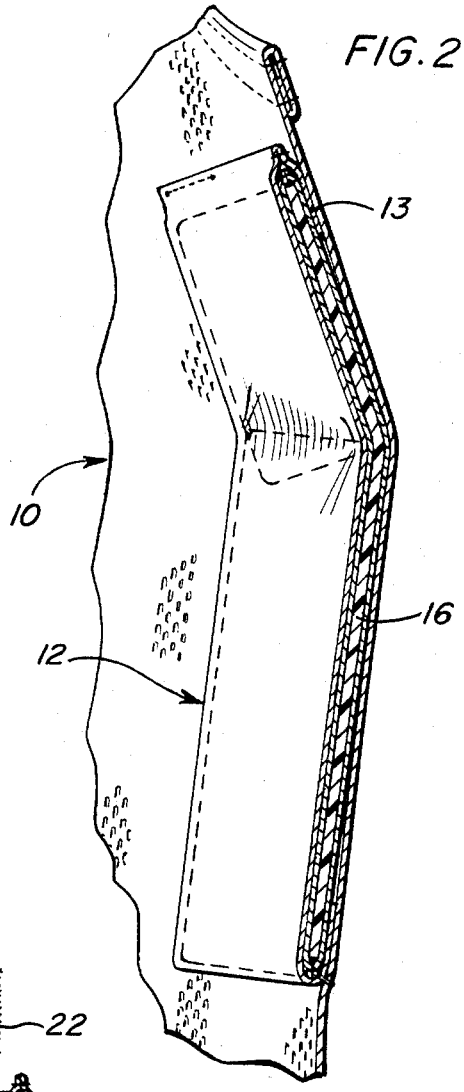
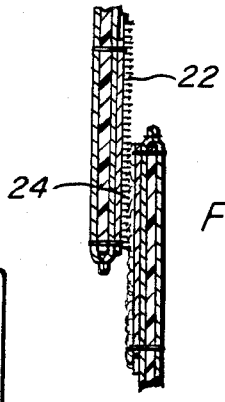
FIG. 5
FIG. 3
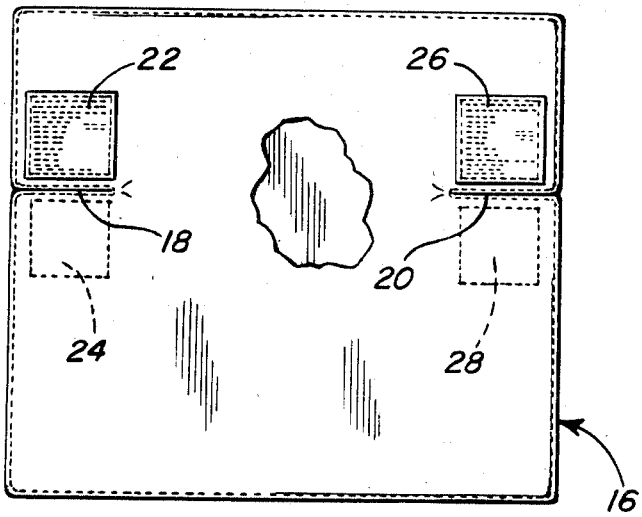
FIG. 4
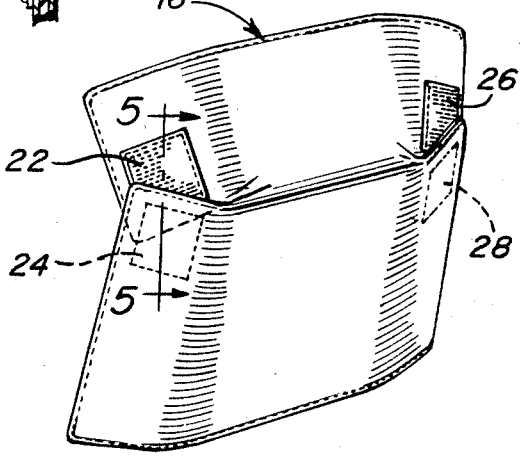

BODY ARMOR FOR WOMEN

BACKGROUND OF THE INVENTION

This invention relates to body armor worn for personal protection against small arms fire and the like, the armor being of the general type disclosed in copending U.S. patent application Ser. No. 496,618, now U.S. Pat. No. 4,535,478, the disclosure of which is incorporated herein by reference in its entirety.

Body armor in accordance with the noted patent application comprises a carrier garment, which preferably may be in the form of a standard-style undergarment, such as a T-shirt and the like, and at least one armor panel insert of soft armor construction in the form of a pad, which is removably inserted into a purpose-made pocket formed in the carrier garment. This arrangement allows for standardization of armor components, provides a comfortable form of body armor which can be worn on a day-to-day basis, and which allows the carrier garment to be washed or laundered while the insert panel is used in conjunction with another carrier garment.

The present invention is a modification of the armor disclosed in the earlier application which is particularly suited for wear by women.

SUMMARY OF THE INVENTION

In accordance with the invention, for body armor of the type described, an armor insert panel for use in a receiving means in the front of a carrier garment is shaped to conform to a woman's bust. Further, in a preferred form of the invention, the insert panel includes adjustment means enabling the panel to be shaped to fit different bust sizes. To this end, for example, a flat insert panel of suitable armored material may be formed with a slit extending laterally from each side edge thereof, with complementary VELCRO hook and pile or like tabs secured to opposite faces of the panel on opposite sides of the slit respectively. With this construction, overlapping and engaging the respective tabs causes the panel to assume a cup-shaped configuration, with the degree of overlap determining the cup size. Thus, the panel can be shipped or transported in the flat, in order to conserve space, and can be formed in the required cup size in situ by a user, prior to insertion in the pocket in the front of the carrier garment. Further, the panel can be used flat if required, for example, for use in a man's carrier garment. An extremely versatile form of insert panel is accordingly provided by the invention.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWINGS

FIG. 1 is a perspective view of a woman's undergarment incorporating an armor insert panel in accordance with the invention.

FIG. 2 is an enlarged cross-sectional view on line 2—2 of FIG. 1.

FIG. 3 is a front elevational view of the armor insert panel.

FIG. 4 is a perspective view of the armor insert panel.

FIG. 5 is an enlarged sectional view on line 5—5 of FIG. 4.

DESCRIPTION OF PREFERRED EMBODIMENT

A woman's undergarment 10 in the form of a T-shirt or undervest of any suitable material, such as cotton, polyester, or a blend, and of conventional form and construction, is formed with internal front and rear pockets 12 and 14 for armor insert panels, only the front panel 16 of which is shown. The construction of the pockets and of the armor insert panels, and the manner of insertion and retention of the panels in the pockets may be as described in the above-noted patent application, and will not therefore be described herein in detail, except to note that the pockets may be formed with panel-retaining flaps along their open edges, such as flap 13 in FIG. 2, and the panels may be formed from bullet-resistant material such as multiple layers of "Kevlar" fabric in a suitable sheath.

Front panel 16 may, for example, be about 12½" wide and 11½" in height. About seven inches up from the bottom edge, the panel may have lateral slits 18, 20 (FIG. 3) extending about two inches in from the side edges, the panel being suitably seamed around each slit. Complementary VELCRO hook and pile tabs 22, 24 and 26, 28 are sewn onto the panel on opposite sides of the respective slits, and the tabs of each pair are positioned respectively on opposite surfaces of the panel. The tabs may be about 1¾" square. This construction allows the edge portions of the panel defining the respective slits to be overlapped as best shown in FIG. 4, and releasably secured together by means of the VELCRO hook and pile tabs, forming the panel into cup-like shape so as to accommodate a woman's bust. Further, the degree of overlap of the tabs may be adjusted to vary the cup size of the panel. The panel may be shipped flat, and formed into the cupped shape of the required size in situ by a user prior to insertion in pocket 12 of garment 10

The invention thus provides a convenient and comfortable form of women's body armor garment, adaptable as to size, and which has the advantages noted in connection with the aforementioned patent application.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An insert panel of flexible armored material for use in conjunction with a carrier garment to provide an article of body armor, the panel having upper, lower and side edges, a slit extending inwardly from each side edge, so that edge portions of the panel defining the respective slits can be overlapped to form the panel into a cup-like shape for accommodating a woman's bust, the degree of overlap of the edge portions determining the cup size, and means for releasably securing the edge portions together when overlapped.

2. The invention of claim 1 wherein the securing means comprises a pair of hook and pile type fastener tabs on opposite sides respectively of each slit, the tabs of each pair being secured respectively on opposite surfaces of the panel.

3. The invention of claim 2 wherein each slit is about two inches in length and each tab is about $1\frac{3}{4}''$ square.

4. The invention of claim 1 wherein the panel is formed from multiple layers of bullet-resistant material in a retaining sheath.

5. An article of woman's body armor comprising a torso-embracing carrier garment including a front panel of armored material shaped to accommodate the wearer's bust wherein the panel includes means for adjusting the shape thereof to accommodate different bust sizes.

6. The invention of claim 5 wherein the panel is removably received in a pocket formed in the front of the garment.

7. The invention of claim 5 wherein the adjusting means comprises slits extending inwardly from opposite side edges of the panel, and a pair of hook and pile type fastener tabs on opposite sides of each slit, the tabs of each pair being secured respectively on opposite surfaces of the panel.

8. In combination; a woman's torso-embracing garment such as a T-shirt or undervest, having a front pocket extending over the bust area thereof, and an insert panel of flexible armored material for receipt in the pocket, the panel being formed for shaping to accommodate the wearer's bust wherein the panel has a pair of slits extending inwardly from respectives side edges thereof enabling edge portions of the panel defining the slits to be overlapped to form the panel into a bust-accommodating form, and means for releasably securing said edge portions together when overlapped.

9. The invention of claim 8 wherein the securing means comprises a pair of hook and pile type fastener tabs on opposite sides of each slit, the tabs of each pair being secured respectively on opposite surfaces of the panel, whereby the degree of overlap of the respective tabs determines the bust size to be accommodated by the panel.

* * * * *